US009153238B2

(12) United States Patent
Jeong et al.

(10) Patent No.: US 9,153,238 B2
(45) Date of Patent: Oct. 6, 2015

(54) METHOD AND APPARATUS FOR PROCESSING AN AUDIO SIGNAL

(75) Inventors: Gyu Hyeok Jeong, Seoul (KR); Hye Jeong Jeon, Seoul (KR); Byung Suk Lee, Seoul (KR); Chang Heon Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 366 days.

(21) Appl. No.: 13/640,042

(22) PCT Filed: Apr. 8, 2011

(86) PCT No.: PCT/KR2011/002487

§ 371 (c)(1),
(2), (4) Date: Jan. 4, 2013

(87) PCT Pub. No.: WO2011/126340

PCT Pub. Date: Oct. 13, 2011

(65) Prior Publication Data

US 2013/0103407 A1 Apr. 25, 2013

Related U.S. Application Data

(60) Provisional application No. 61/321,882, filed on Apr. 8, 2010, provisional application No. 61/321,881, filed on Apr. 8, 2010.

(30) Foreign Application Priority Data

Sep. 3, 2010 (KR) ..... 10-2010-0086488
Sep. 3, 2010 (KR) ..... 10-2010-0086489

(51) Int. Cl.
*G10L 19/00* (2013.01)
*G10L 19/008* (2013.01)
*G10L 19/06* (2013.01)

(52) U.S. Cl.
CPC ..... *G10L 19/008* (2013.01); *G10L 19/06* (2013.01); *G10L 2019/0005* (2013.01)

(58) Field of Classification Search
None
See application file for complete search history.

(56) References Cited

U.S. PATENT DOCUMENTS 5,271,089 A * 12/1993 Ozawa ..... 704/222
5,774,839 A 6/1998 Shlomot (Continued)

FOREIGN PATENT DOCUMENTS

| | | |
|---|---|---|
| CN | 1488135 | 4/2004 |
| EP | 2618331 | 7/2013 |
| KR | 10-2003-0004608 | 1/2003 |
| KR | 10-2004-0027041 | 4/2004 |

OTHER PUBLICATIONS

Office Action in EP Application No. 11 766 191.8, dated Jul. 8, 2014, 6 pages.

(Continued)

*Primary Examiner* — Daniel Abebe
(74) *Attorney, Agent, or Firm* — Fish & Richardson P.C.

(57) ABSTRACT

The present invention relates to a method for processing an audio signal, comprising the following steps: performing a linear predictive analysis on the current frame of an audio signal so as to generate a first target vector, which is a target vector of a first stage, on the basis of a plurality of linear prediction transform coefficients; performing vector quantization on the first target vector so as to acquire a predetermined number of first temporary candidate code vectors of the first stage; calculating first temporary candidate errors, which are errors between the first temporary candidate code vectors and the first target vector; and determining a first number, which is the number of the first candidate code vectors, on the basis of the first temporary candidate errors, and acquiring first final candidate code vectors in the same amount as the first number.

5 Claims, 13 Drawing Sheets

(56) References Cited

U.S. PATENT DOCUMENTS

| | | | | |
|---|---|---|---|---|
| 5,797,119 | A * | 8/1998 | Ozawa | 704/223 |
| 6,018,707 | A | 1/2000 | Nishiguchi et al. | |
| 6,611,800 | B1 * | 8/2003 | Nishiguchi et al. | 704/221 |
| 7,392,179 | B2 | 6/2008 | Yasunaga et al. | |
| 2008/0015852 | A1 * | 1/2008 | Kruger et al. | 704/225 |
| 2013/0173263 | A1 * | 7/2013 | Morii | 704/230 |

OTHER PUBLICATIONS

Kossentini Faouzi et al: "A Fast Searching Technique for Multistage Residual Vector Quantizers", IEEE Signal Processing Letters, vol. 1, No. 7, Jul. 1, 1994, pp. 114-116, XP000462402.

Bhattacharya B et al: "Tree searched multi-stage vector quantization of LPC parameters for 4 kb/s speech coding", Proceedings of the International Conference on Acoustics, Speech and Signal Processing (ICASSP), New York, IEEE, US, vol. 1, Mar. 23, 1992, pp. 105-108, XP01 0058705.

Extended European Search Report in EP Application No. 11766191.8-1910, dated Aug. 13, 2013, 12 pages.

Written Opinion of the International Search Report in International Application No. PCT/KR2011/002487, dated Oct. 21, 2011, 16 pages.

* cited by examiner (A)

(B)

METHOD AND APPARATUS FOR PROCESSING AN AUDIO SIGNAL

TECHNICAL FIELD

The present invention relates to an audio signal processing method and apparatus which can encode or decode audio signals.

BACKGROUND ART

Generally, linear predictive coding (LPC) is performed on an audio signal having strong speech characteristics. Linear predictive coefficients generated through linear predictive coding are transmitted to a decoder and the decoder reconstructs the audio signal by performing linear predictive synthesis on the coefficients.

DISCLOSURE

Technical Problem

Vector quantization is performed to transmit linear predictive coefficients or linear predictive conversion coefficients to the decoder. During vector quantization, a quantization error occurs, causing sound quality distortion.

In addition, when a large number of candidate vectors are acquired in order to minimize quantization errors when performing vector quantization in multiple stages, there is a problem in that complexity increases geometrically according to the number of candidate vectors.

Technical Solution

An object of the present invention devised to solve the problem lies in providing an audio signal processing method and apparatus which can minimize quantization errors when linear predictive conversion coefficients are vector-quantized.

Another object of the present invention is to provide an audio signal processing method and apparatus for adaptively changing the number of candidate vectors in each stage.

Another object of the present invention is to provide an audio signal processing method and apparatus for replacing candidate vectors with optimal best code vectors in a stage having a great error while reducing the number of candidate vectors to a smaller number.

Advantageous Effects

The present invention provides the following effects and advantages.

First, it is possible to minimize an increase in complexity according to the number of candidate vectors since the number of candidate vectors is changed adaptively in each stage when multi-stage vector quantization is performed.

Second, it is possible to reduce quantization errors while minimizing an increase in complexity since the number of candidate vectors of each stage is determined based on errors.

Third, when the total number of stages is N and M candidate vectors are present in each stage, the total number of the set of candidate vectors increases geometrically (MN). However, it is possible to minimize complexity by reducing the number of candidate vectors to 1 or 2.

Fourth, it is not only possible to minimize complexity by reducing the number of candidate vectors but it is also possible to reduce quantization errors by replacing candidate vectors with optimal best code vectors generated through re-search in the case of a stage having a great error.

BEST MODE

Figure 1:
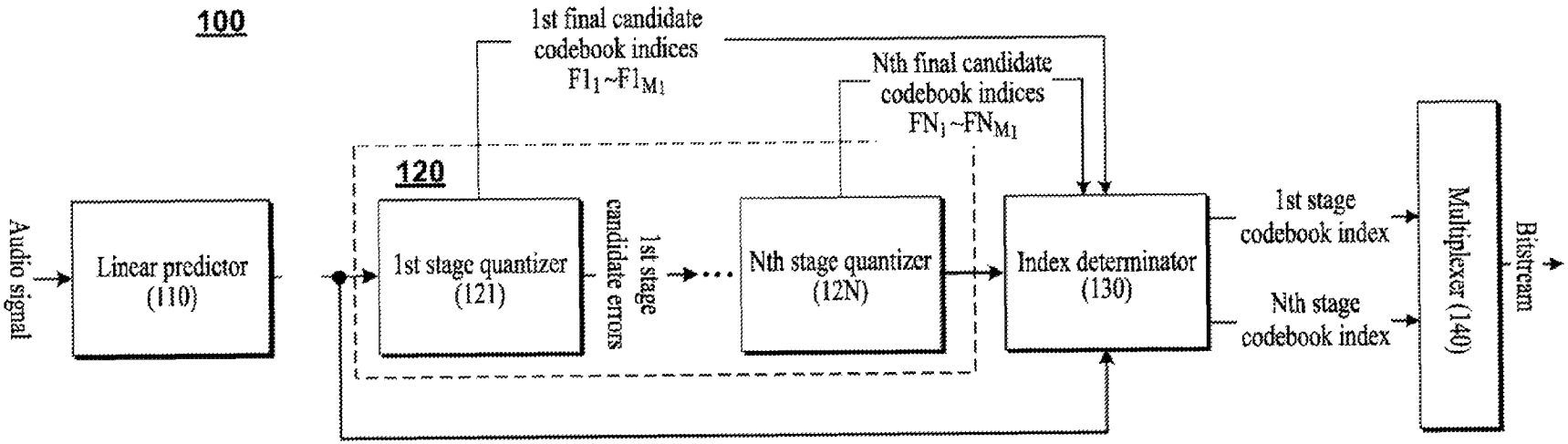
FIG. 1 illustrates a configuration of an encoder included in an audio signal processing apparatus according to an embodiment of the present invention.

In order to achieve the objects, an audio signal processing method according to the present invention includes performing linear predictive analysis on a current frame of an audio signal to generate a first target vector which is a target vector of a first stage based on a plurality of linear predictive conversion coefficients, vector-quantizing the first target vector to acquire a temporarily determined number of first temporary candidate code vectors of the first stage, calculating first temporary candidate errors which are errors between the first temporary candidate code vectors and the first target vector, and determining a first number which is the number of first candidate code vectors based on the first temporary candidate errors and acquiring the same number of first final candidate code vectors as the first number.

According to the present invention, the audio signal processing method may further include generating first final candidate errors as target vectors of a second stage based on the first final candidate code vectors, vector-quantizing the second target vectors to acquire a temporarily determined number of second temporary candidate code vectors of the second stage, calculating second temporary candidate errors which are errors between the second temporary candidate code vectors and the second target vectors, and determining a second number which is the number of second candidate code vectors based on the second candidate errors and acquiring the same number of second final candidate code vectors as the second number.

According to the present invention, acquiring the second temporary candidate code vectors may include acquiring the same number of temporary candidate code vectors as a which is an arbitrary natural number for each of the second target vectors, and removing part of the temporary code vectors to acquire the temporarily determined number of second temporary candidate code vectors.

According to the present invention, the temporarily determined number may be calculated based on a predetermined table value or the first number.

According to the present invention, the first number may be determined based on the first temporary candidate errors and a threshold.

According to the present invention, the first number may be determined to be a small number if an increment of the first temporary candidate errors gradually decreases after the first temporary candidate errors are arranged in ascending order.

In accordance with another aspect of the present invention, there is provided an audio signal processing method including performing linear predictive analysis on a current frame of an audio signal to generate a first target vector which is a target vector of a first stage based on a plurality of linear predictive conversion coefficients, vector-quantizing the first target vector to acquire a temporarily determined number of first final candidate code vectors of the first stage, calculating first final candidate errors which are errors between the first final candidate code vectors and the first target vector, and determining a second number which is the number of second candidate code vectors of a second stage based on the first final candidate errors.

According to the present invention, the audio signal processing method may further include generating first final candidate errors as target vectors of the second stage based on the first candidate code vectors, vector-quantizing the second target vectors to acquire the same number of second temporary candidate code vectors of the second stage as the second number, calculating second temporary candidate errors which are errors between the second temporary candidate code vectors and the second target vectors, and determining a third number which is the number of third candidate code vectors of a third stage based on the second temporary candidate errors.

In accordance with another aspect of the present invention, there is provided an audio signal processing apparatus including a linear predictor for performing linear predictive analysis on a current frame of an audio signal to generate a first target vector which is a target vector of a first stage based on a plurality of linear predictive conversion coefficients, a temporary candidate vector generator for vector-quantizing the first target vector to acquire a temporarily determined number of first temporary candidate code vectors of the first stage, an error generator for calculating first temporary candidate errors which are errors between the first temporary candidate code vectors and the first target vector, and a current number determinator for determining a first number which is the number of first candidate code vectors based on the first temporary candidate errors and acquiring the same number of first final candidate code vectors as the first number.

In accordance with another aspect of the present invention, there is provided an audio signal processing apparatus including a linear predictor for performing linear predictive analysis on a current frame of an audio signal to generate a first target vector which is a target vector of a first stage based on a plurality of linear predictive conversion coefficients, a candidate vector generator for vector-quantizing the first target vector to acquire a temporarily determined number of first final candidate code vectors of the first stage, an error generator for calculating first final candidate errors which are errors between the first final candidate code vectors and the first target vector, and a next number determinator for determining a second number which is the number of second candidate code vectors of a second stage based on the first final candidate errors.

In accordance with another aspect of the present invention, there is provided an audio signal processing method including performing linear predictive analysis on a current frame of an audio signal and generating a first target signal based on a plurality of linear predictive conversion coefficients, performing vector quantization on a first stage based on the first target signal, the vector quantization including generating first candidate code vectors including a first initial best code vector having a smallest error based on the first target signal and outputting a first initial best error corresponding to the first initial best code vector as a second target signal which is a target signal of a second stage, repeatedly performing the vector quantization from the second stage to an Nth stage, determining a Kth stage (K=1, . . . , N) in which index update is to be performed from among the first to Nth stages, correcting the Kth target signal using the first target signal and an Kth-excluded sum signal, determining a Kth optimal best code vector from among Kth candidate code vectors based on the corrected Kth target signal, and selecting one of a Kth initial best code vector and the Kth optimal best code vector as a Kth final best code vector, wherein the Kth-excluded sum signal is a sum of first to Nth initial best code vectors excluding the Kth initial best code vector.

According to the present invention, there is provided the audio signal processing method wherein the selection is performed based on a total error of the Kth initial best code vector and a total error of the Kth optimal best code vector, the total error of the Kth initial best code vector is a difference between a vector obtained by summing the Kth-excluded sum signal and the Kth initial best code vector and the first target signal, and the total error of the Kth initial best code vector is a difference between a vector obtained by summing the Kth-excluded sum signal and the Kth initial best code vector and the first target signal.

According to the present invention, the audio signal processing method further includes determining a K+ath stage (a: integer) in which index update is to be performed from among the first to Nth stages, and repeating the update, the determination, and the selection for the K+ath stage.

According to the present invention, the determination of the K+ath stage and the repetition may be performed when the Kth optimal best code vector is determined to be the Kth final best code vector.

In accordance with another aspect of the present invention, there is provided an audio signal processing apparatus including a linear predictor for performing linear predictive analysis on a current frame of an audio signal and generating a first target signal based on a plurality of linear predictive conversion coefficients, initial quantizer for performing vector quantization on a total of N stages based on the first target signal, the initial quantizer including a first initial quantizer that performs vector quantization on the first stage by generating first candidate code vectors including a first initial best code vector having a smallest error based on the first target signal and outputting a first initial best error corresponding to the first initial best code vector as a second target signal which is a target signal of a second stage and the ith initial quantizer for performing the vector quantization based on the ith target signal (i=2, . . . , N), an update controller for determining a Kth stage (K=1, . . . , N) in which index update is to be performed from among the first to Nth stages, a Kth stage target signal corrector for correcting the Kth target signal using the first target signal and an Kth-excluded sum signal, a re-searcher for determining a Kth optimal best code vector from among Kth candidate code vectors based on the corrected Kth target signal, and an update determinator for selecting one of a Kth initial best code vector and the Kth optimal best code vector as a Kth final best code vector, wherein the Kth-excluded sum signal is a sum of first to Nth initial best code vectors excluding the Kth initial best code vector.

[Mode For Invention]

Preferred embodiments of the present invention will now be described in detail with reference to the accompanying drawings. Prior to the description, it should be noted that the terms and words used in the present specification and claims should not be construed as being limited to common or dictionary meanings but instead should be understood to have meanings and concepts in agreement with the spirit of the present invention based on the principle that an inventor can define the concept of each term suitably in order to describe his/her own invention in the best way possible. Thus, the embodiments described in the specification and the configurations shown in the drawings are simply the most preferable examples of the present invention and are not intended to illustrate all aspects of the spirit of the present invention. As such, it should be understood that various equivalents and modifications can be made to replace the examples at the time of filing of the present application.

The following terms used in the present invention may be construed as described below and other terms, which are not described below, may also be construed in the same manner. A term "coding" may be construed as encoding or decoding as needed and "information" is a term encompassing values, parameters, coefficients, elements, and the like and the meaning thereof varies as needed although the present invention is not limited to such meanings of the terms.

Here, in the broad sense, the term "audio signal" is distinguished from "video signal" and indicates a signal that can be audibly identified when reproduced. In the narrow sense, the term "audio signal" is discriminated from "speech signal" and indicates a signal which has little to no speech characteristics. In the present invention, the term "audio signal" should be construed in the broad sense and, when used as a term distinguished from "speech signal", the term "audio signal" may be understood as an audio signal in the narrow sense.

In addition, although the term "coding" may indicate only encoding, it may also have a meaning including both encoding and decoding.

FIG. 1 illustrates a configuration of an encoder included in an audio signal processing apparatus according to an embodiment of the present invention. As shown in FIG. 1, the encoder includes multi-stage quantizers 120 including 1st to Nth stage quantizers 121 to 12N and may further include a linear predictor 110, an index determinator 130, and a multiplexer 140.

The linear predictor 110 performs linear predictive analysis according to linear predictive coding (LPC) on an input audio signal to generate linear predictive coefficients and converts the linear predictive coefficients into linear predictive conversion coefficients.

The basic concept of linear predictive coding is that a linear predictive value at a given time n can be approximated by a linear combination of p audio signals provided until the given time n. This can be mathematically expressed as follows.

$$S(n) \approx q_1 S(n-1) + q_2 S(n-2) + \ldots + q_p S(n-p) \qquad \text{Expression 1}$$

Here, $q_i$ is the linear predictive coefficient, n is sample index, and p is linear predictive order.

Since the linear predictive coefficients acquired in this manner have a large dynamic range, each of the linear predictive coefficients needs to be quantized into a smaller number of bits and, since the linear predictive coefficients are weak to quantization errors, the linear predictive coefficients need to be converted into coefficients robust to quantization errors.

Accordingly, the linear predictor 110 converts the linear predictive coefficients into linear predictive conversion coefficients Wi. The linear predictive conversion coefficient may be one of Line Spectral Pairs (LSP), Immittance Spectral Pairs (ISP), Line Spectrum Frequency (LSF), or Immittance Spectral Frequency (ISF) although the present invention is not limited thereto. Here, the ISF may be represented as in the following Expression.

$$\begin{aligned} f_i &= \frac{f_s}{2\pi}\arccos(q_i),\ i = 1, \ldots, 15 \\ &= \frac{f_s}{4\pi}\arccos(q_i),\ i = 16 \end{aligned} \qquad \text{Expression 2}$$

Here, $q_i$ is a linear predictive coefficient, $f_i$ denotes a frequency region of [0, 6400 Hz] of the ISF, and $f_s$=12800 is a sampling frequency.

A target vector, which is to be vector-quantized, may be generated based on a plurality of linear predictive conversion coefficients generated by such linear predictive coding (LPC). Here, the target vector may be generated from the differences between a plurality of linear predictive conversion coefficients of a current frame and a plurality of linear predictive conversion coefficients of a previous frame. This target vector is referred to as a 1st stage (which will hereinafter be referred to as a 1st target vector for short) since the target vector is input to the 1st stage quantizer 121 among the multi-stage quantizers 120.

The multi-stage quantizers 120 include 1st to Nth stage quantizers 121 to 12N. Each of the 1st to Nth stage quantizers 121 to 12N generates candidate code vectors, the number of which is determined adaptively in the corresponding stage, and provides a candidate codebook index corresponding to the candidate code vectors to the index determinator 130.

Specifically, the 1st stage quantizer 121 vector-quantizes the 1st target vector to generate a 1st number ($M_1$) of 1st final candidate codebook indices $F1_1$ to $F1_{M1}$, where $M_1$ is the number of the 1st stage candidate code vectors. The 1st final candidate codebook indices $F1_1$ to $F1_{M1}$ are provided to the index determinator 130 of FIG. 1.

The Nth stage quantizer 12N vector-quantizes the Nth target vector to generate an Nth number ($M_N$) of Nth final candidate codebook indices $F1_1$ to $F1_{MN}$, where $M_N$ is the number of the Nth stage candidate code vectors.

Here, each of the 1st to Nth numbers $M_N$ is determined adaptively based on temporary candidate errors in the corresponding stage (current stage or previous stage). The case in which the number of candidate vectors of the current stage is determined in the current stage corresponds to an intra-stage scheme and the case in which the number of candidate vectors of the current stage is determined in the previous stage (or the number of candidate vectors of the previous stage is determined in the current stage) corresponds to an inter-stage scheme. In this specification, the intra-stage scheme is referred to as a first embodiment and the inter-stage scheme is referred to as a second embodiment. A 1st stage quantizer 121-A and an Nth stage quantizer 12N-A corresponding to the first embodiment (intra-stage) will be described with reference to FIGS. 2 and 3 and a 1st stage quantizer 121-B and an Nth stage quantizer 12N-B corresponding to the second embodiment (inter-stage) will be described with reference to FIGS. 5 and 6.

The index determinator 130 combines the 1st number of 1st final candidate codebook indices (and the 1st final candidate code vectors) and the Nth number of Nth final candidate codebook indices (and the Nth final candidate code vectors) to determine a plurality of candidate sets of candidate code vectors, each of which is a combination of N code vectors respectively from the 1st to Nth stages. In the case of a total of N stages, this candidate set is an N-dimension vector. The index determinator 130 determines one candidate set, which has the smallest error from the target vector (i.e., the 1st target vector), from among the plurality of candidate sets. Indices corresponding to this set (i.e., the 1st stage to Nth stage codebook indices) are provided to the multiplexer 140.

The multiplexer 140 multiplexes data including the 1st stage to Nth codebook indices received from the index determinator 130 to generate one or more bitstreams and transmits the bitstreams to a decoder.

Figure 2:
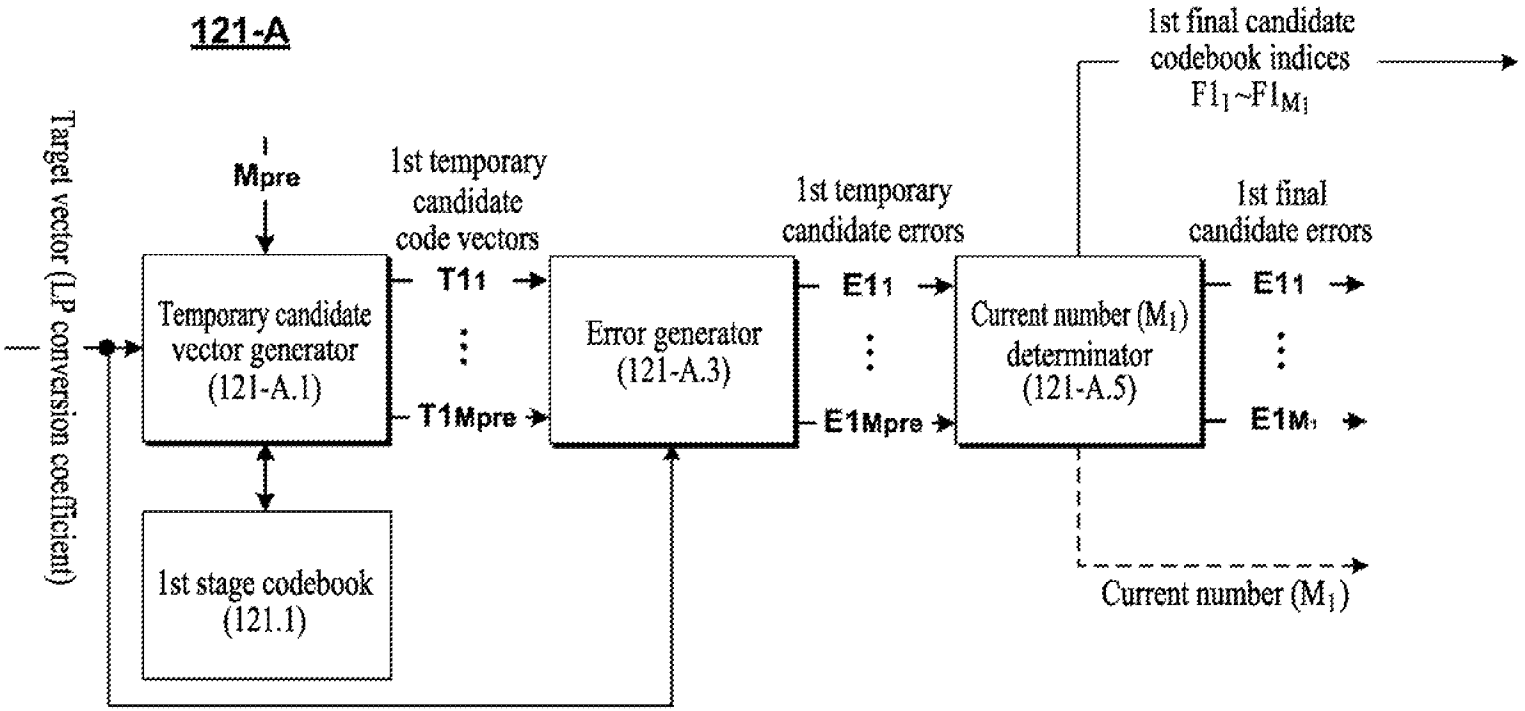
FIG. 2 illustrates a configuration of a first embodiment 121-A of a 1st stage quantizer 121 of FIG. 1.
Figure 3:
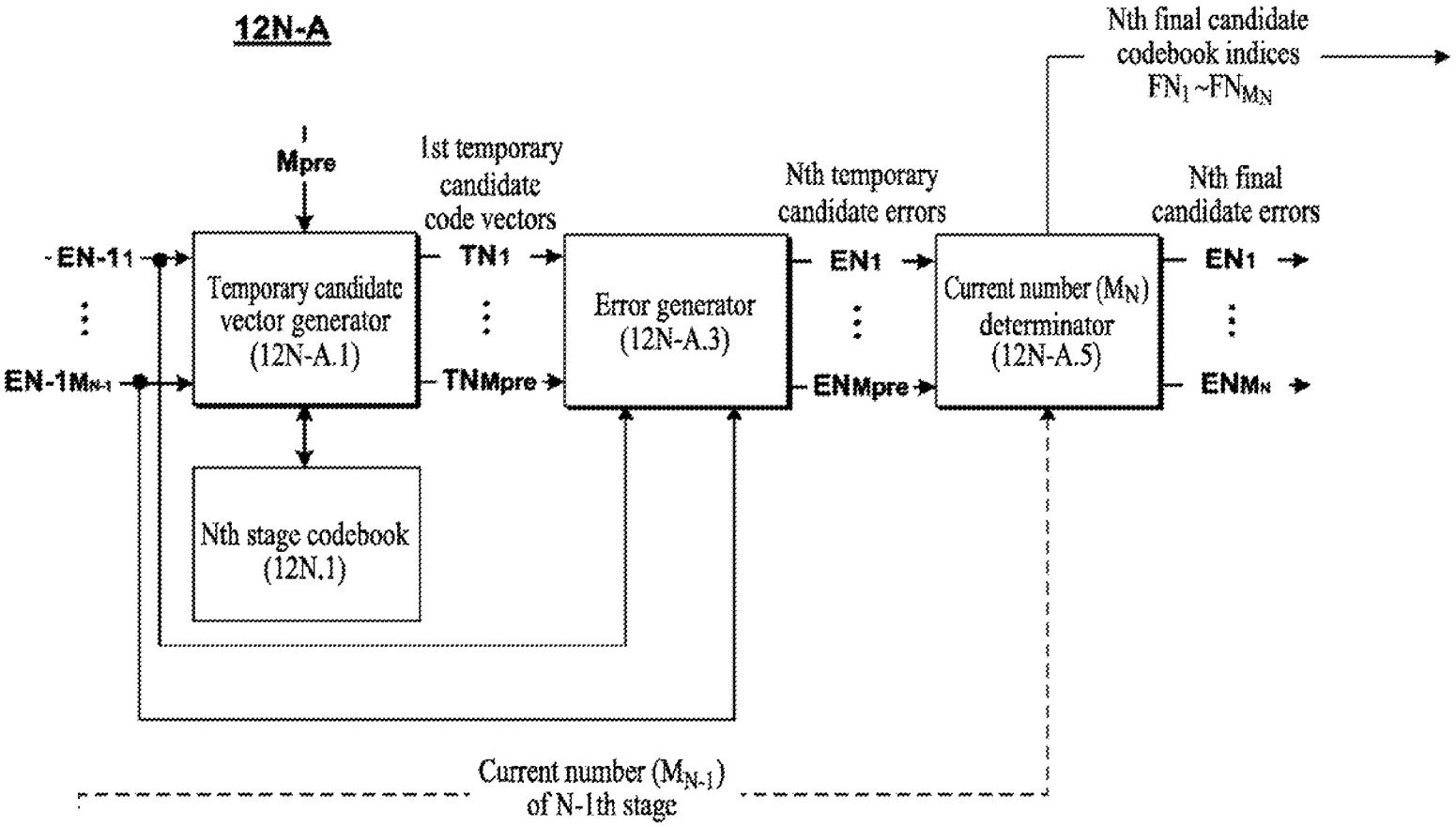
FIG. 3 illustrates a configuration of a first embodiment 12N-A of an Nth stage quantizer 12N of FIG. 1.

FIG. 2 illustrates a configuration of a first embodiment 121-A of the 1st stage quantizer 121 of FIG. 1 and FIG. 3 illustrates a configuration of a first embodiment 12N-A of the Nth stage quantizer 12N of FIG. 1. The first embodiment corresponds to the intra-stage scheme in which the number of candidate code vectors of the current stage is determined in the current stage as described above.

As shown in FIG. 2, the 1st stage quantizer 121-A according to the first embodiment includes a temporary candidate vector generator 121-A.1, an error generator 121-A.3, and a current number determinator 121-A.5 and may further include a 1st stage codebook 121.1.

The temporary candidate vector generator 121-A.1 vector-quantizes the 1st target vector using the codebook 121.1 of the 1st stage to acquire a temporarily determined number ($M_{pre}$) of 1st temporary candidate code vectors $T1_1$ to $T1_{Mpre}$ of the 1st stage. Here, the codebook 121.1 of the 1st stage corresponds to a codebook for quantization of the 1st stage among the multiple stages.

The temporarily determined number ($M_{pre}$) may be a predetermined table value. In addition, the temporarily determined number may be a total number of candidate code vectors and may also be the number of candidate code vectors per target signal when a plurality of target signals is present. The table value may differ for each mode. As the table value, the number of candidate code vectors per target signal may be 7 in the case of a transition coding (TC) mode and may be 4 in other modes (such as a voiced coding (VC) mode, an unvoiced coding (UC) mode, and a general coding (GC) mode). Here, each table value may be reduced in a specific stage as shown in the following table.

TABLE 1

| Coding mode | ISF quantization scheme | Stage |
|---|---|---|
| UC, WB | safety-net | 6 |
| UC, NB | safety-net | 5 |
| VC, WB | safety-net | 5, 6 |
| | strongly predictive | 3, 5 |
| VC, NB | weakly predictive | 5, 6 |
| | strongly predictive | 3, 5 |
| GC, WB | safety-net | 5, 6 |
| | strongly predictive | 4, 6 |
| GC, NB | safety-net | 6 |
| | strongly predictive | 4, 6 |
| TC, WB | safety-net | 6 |
| TC, NB | safety-net | — |

For example, in the UC mode, the table value may be a value smaller than 4 rather than 4 in the 5th stage or the 6th stage although the present invention is not limited thereto.

The error generator 121-A.3 generates 1st temporary candidate errors $E1_l$ to $E1_{Mpre}$ which are errors between the 1st temporary candidate code vectors $T1_1$ to $T1_{Mpre}$ and the 1st target vector. Here, the temporary candidate errors may be generated according to the following Expression.

$$E_{warr}(p) = \sum_{i=0}^{15} w_{and}(i)\left[\frac{1}{\sigma_s} r(i) - c_s^p(i)\right]^2, \quad \text{for } p = 1, \ldots, P, \qquad \text{Expression 3}$$

Here, w(i) is a weight, r(i) is the 1st target vector, $C_s^p(i)$ are 1st temporary candidate code vectors, $\sigma_s$ is a normalization factor in the sth stage, and P is the temporarily determined number $M_{pre}$.

The current number determinator 121-A.5 determines the current number of candidate code vectors in the current stage based on the 1st temporary candidate errors $E1_l$ to $E1_{Mpre}$ generated by the error generator 121-A.3. Here, the current number determinator 121-A.5 determines a 1st number ($M_1$) which is the number of 1st candidate code vectors since the current stage is the 1st stage. Here, a threshold may be used as a reference for determining the current number (i.e., the 1st number).

Specifically, the 1st temporary candidate errors are arranged in ascending order and a parameter indicating statistical characteristics is generated. Here, the parameter may include at least one of a mean, a variance, a minimum, a maximum, and a gradient. The 1st number (i.e., the current number of code vectors) is determined based on the parameter (threshold) generated based on the 1st temporary candidate errors.

In a first embodiment, the current number is determined to be a large number when the average of the errors is greater than the threshold and is determined to be a small number when the average of the errors is less than the threshold. That is, when there is a great error, the number of candidates is increased to reduce the quantization error although complexity is increased. On the other hand, when there is a small error, the number of candidates is reduced to reduce complexity since the quantization error may not be increased even though the number of candidates is reduced.

In a second embodiment, 1st temporary candidate errors may be arranged in ascending order and thereafter the current number (the 1st number in the 1st stage) may be determined to be a relatively small number when the increment of the arranged errors (i.e., the difference value $D_k = E1_k - E1_{k-1}$) gradually decreases. On the other hand, the current number may be determined to be a relatively large number when the increment of the arranged errors gradually increases and may be determined to be a relatively small number when the increment of the arranged errors gradually decreases. In the case in which the increment gradually decreases, there are a relatively large number of codebook indices (and corresponding code vectors) having a small quantization error in the current stage. In this case, the probability that the same index is selected for codebook indices of the next stage is increased and therefore an increase in the performance is small compared to the increase in the number of candidates. Thus, in this case, it is efficient to reduce the number of candidates. On the other hand, in the case in which the increment gradually increases, the quantization error difference between a codebook index having the smallest quantization error and a codebook index having the second smallest quantization error is great. In this case, by increasing the number of candidates, it is possible to reduce redundancy of selected indices according to the number of candidates of the next stage, thereby increasing the combination of codebook indices.

After the current number (1st number) $M_1$ of the 1st stage is determined in this manner, the same number of 1st final candidate code vectors ($FV1_1$ to $FV1_{M1}$) as the 1st number are generated and corresponding 1st final candidate indices $F1_1$ to $F1_{M1}$ are output. Here, the number of 1st final candidate indices $F1_1$ to $F1_{M1}$ also corresponds to the 1st number $M_1$. On the other hand, 1st final candidate errors $E1_1$ to $E1_{M1}$ are generated by calculating errors between the 1st target vector and the 1st candidate code vectors $FV1_1$ to $FV1_{M1}$. Here, the errors may be generated in almost the same manner as the above Expression 3. The 1st number of 1st final candidate errors $E1_1$ to $E1_{M1}$ are input as target vectors of the 2nd stage (i.e., 2nd target vectors) to the temporary candidate vector generator 12N-A.1 (N=2) of the 2nd stage quantizer 12N (N=2) of the 2nd stage.

The current number determinator 121-A.5 may additionally provide the current number (i.e., the 1st number) $M_1$ of the 1st stage to a quantizer of the next stage (i.e., the 2nd stage). In this case, the current number of the 1st stage may be used when the quantizer of the next sage determines the number of code vectors.

The Nth stage quantizer 12N-A (where N is an integer equal to or greater than 2) is described below with reference to FIG. 3. The Nth stage quantizer 12N-A includes a candidate vector generator 12N-A.1, an error generator 12N-A.3, and a current number determinator 12N-A.5 and may also include an Nth stage codebook 12N.1. Components of the Nth stage quantizer 12N perform almost the same functions as corresponding components of the 1st stage quantizer 121 and therefore the components of the Nth stage quantizer 12N are described below mainly focusing on the differences from those of the 1st stage quantizer 121.

The temporary candidate vector generator 12N-A.1 receives an N−1th number ($M_{N-1}$) (which is an integer equal to or greater than 1) of N−1th final candidate errors $EN-1_1$ to $EN-1_{MN-1}$ as Nth stage target vectors (hereinafter referred to as Nth target vectors) from the N−1th stage quantizer. The temporary candidate vector generator 12N-A.1 vector-quantizes the Nth stage target vectors $EN-_1$ to $EN-_{MN-1}$ using the Nth stage codebook 12N.1 to generate a temporarily determined number ($M_{pre}$) of Nth temporary candidate code vectors $TN_1$ to $TN_{Mpre}$. Here, although the temporarily determined number ($M_{pre}$) in the Nth stage may be a value stored in a table, the temporarily determined number ($M_{pre}$) in the Nth stage may also be calculated based on the number (i.e., the N−1th number) of the N−1th stage unlike the temporarily determined number of the 1st stage. The temporarily determined number ($M_{pre}$) may be a×N−1th number ($M_{N-1}$), where a indicates the total number of candidates per target vector.

Figure 4:
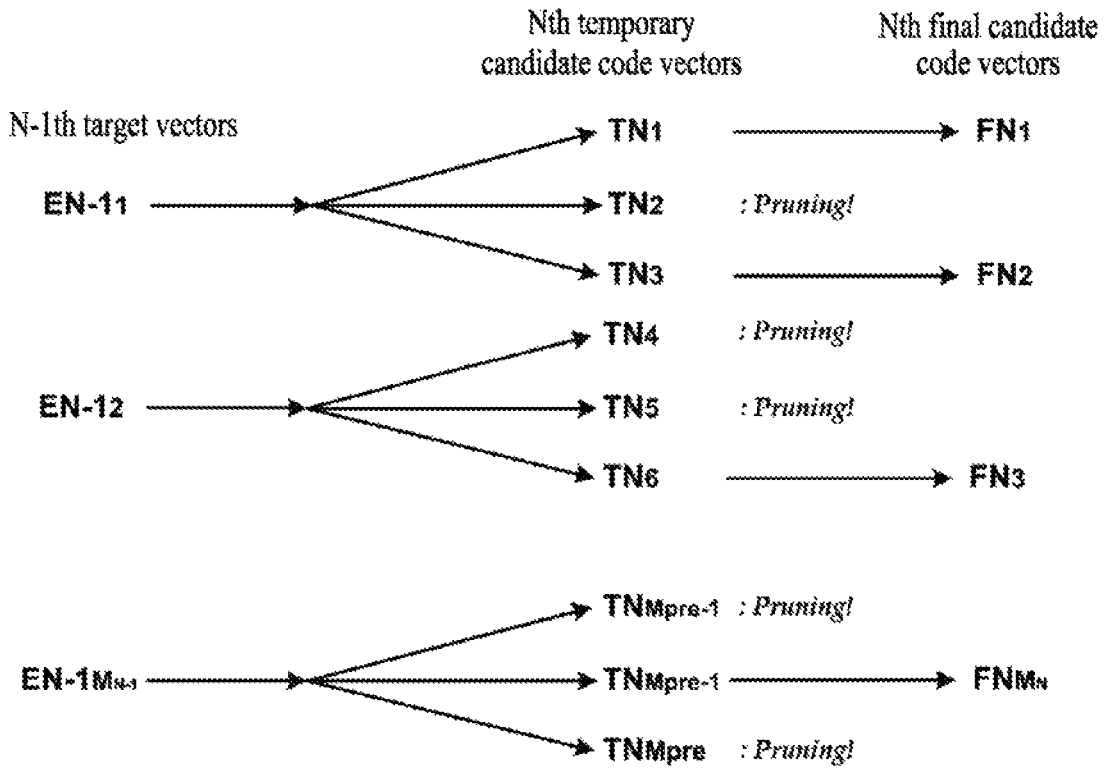
FIG. 4 illustrates operation of the Nth stage quantizer 12N.

FIG. 4 illustrates operation of the Nth stage quantizer 12N. As shown in FIG. 4, an N−1th number ($M_{N-1}$) of N−1th target vectors are present and a (a=3) temporary candidate code vectors $TN_1$ to $TN_{Mpre}$ are generated for each of the target vectors. Here, the temporarily determined number ($M_{pre}$) corresponds to $3\times M_{N-1}$.

Referring back to FIG. 3, the error generator 12N-A.3 generates Nth temporary candidate errors $EN_1$ to $EN_{Mpre}$ by calculating errors between the Nth target vectors $EN-1_1$ to $EN-1_{MN-1}$ and the temporarily determined number of Nth temporary candidate code vectors $TN_1$ to $TN_{Mpre}$.

The current number determinator 12N-A.5 determines a current number (i.e., Nth number $M_N$) based on the Nth temporary candidate errors $EN_1$ to $EN_{Mpre}$. A detailed description of the method of determining the current number is omitted herein since it is similar to the method of the current number determinator 121-A.5 of FIG. 2. However, the current number determinator 12N-A.5 may determine the current number additionally based on the current number $M_{N-1}$ of the previous stage (i.e., the N−1th stage). Specifically, the current number determinator 12N-A.5 may finally determine the current number by appropriately combining the current number $M_N$ determined using the method performed by the current number determinator of the 1st stage and the number $M_{N-1}$ of the previous stage. If there is a next stage, the current number determinator 12N-A.5 may additionally provide the Nth number $M_N$ to the N+1th quantizer, similar to the current number determinator of the 1st stage.

After the current number determinator determines the current number $M_N$ (the Nth number) of the Nth stage as described above, the current number determinator generates the same number of Nth final candidate code vectors $FVN_1$ to $FVN_{MN}$ as the determined current number and Nth final candidate codebook indices $FN_1$ to $FN_{MN}$ and Nth final candidate errors $EN_1$ to $EN_{MN}$ corresponding to the Nth final candidate code vectors $FVN_1$ to $FVN_{MN}$. On the other hand, referring back to FIG. 4, $a\times M_{N-1}$ (a=3) Nth temporary candidate code vectors are generated as described above. Thereafter, when only some of the temporary candidate vectors have been selected as the Nth final candidate code vectors as the current number $M_N$ is determined, this results in that unselected temporary candidate code vectors $TN_2$, $TN_4$, $TN_5$, $TN_6$, $TN_{Mpre-1}$, and $TN_{Mpre-1}$ are removed or pruned.

According to the intra-stage scheme described above with reference to FIGS. 2 to 4, the number of candidate code vectors of the current stage is determined based on target vectors of the current stage as described above. The number of the previous stage may also be used to determine the current number in the intra-stage scheme as described above.

The inter-stage scheme in which the number of the next stage is determined using the current target vectors) is described below with reference to FIGS. 5 and 6.

Figure 5:
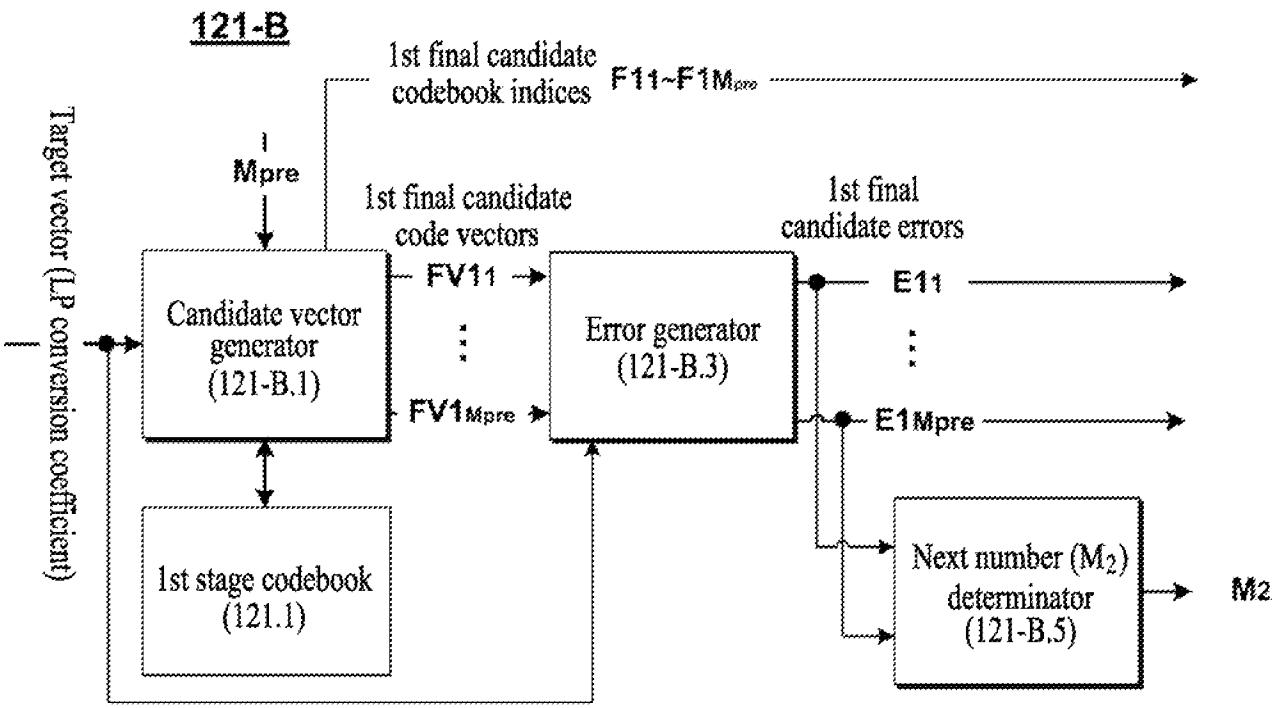
FIG. 5 illustrates a configuration of a second embodiment 121-B of a 1st stage quantizer 121 of FIG. 1.
Figure 6:
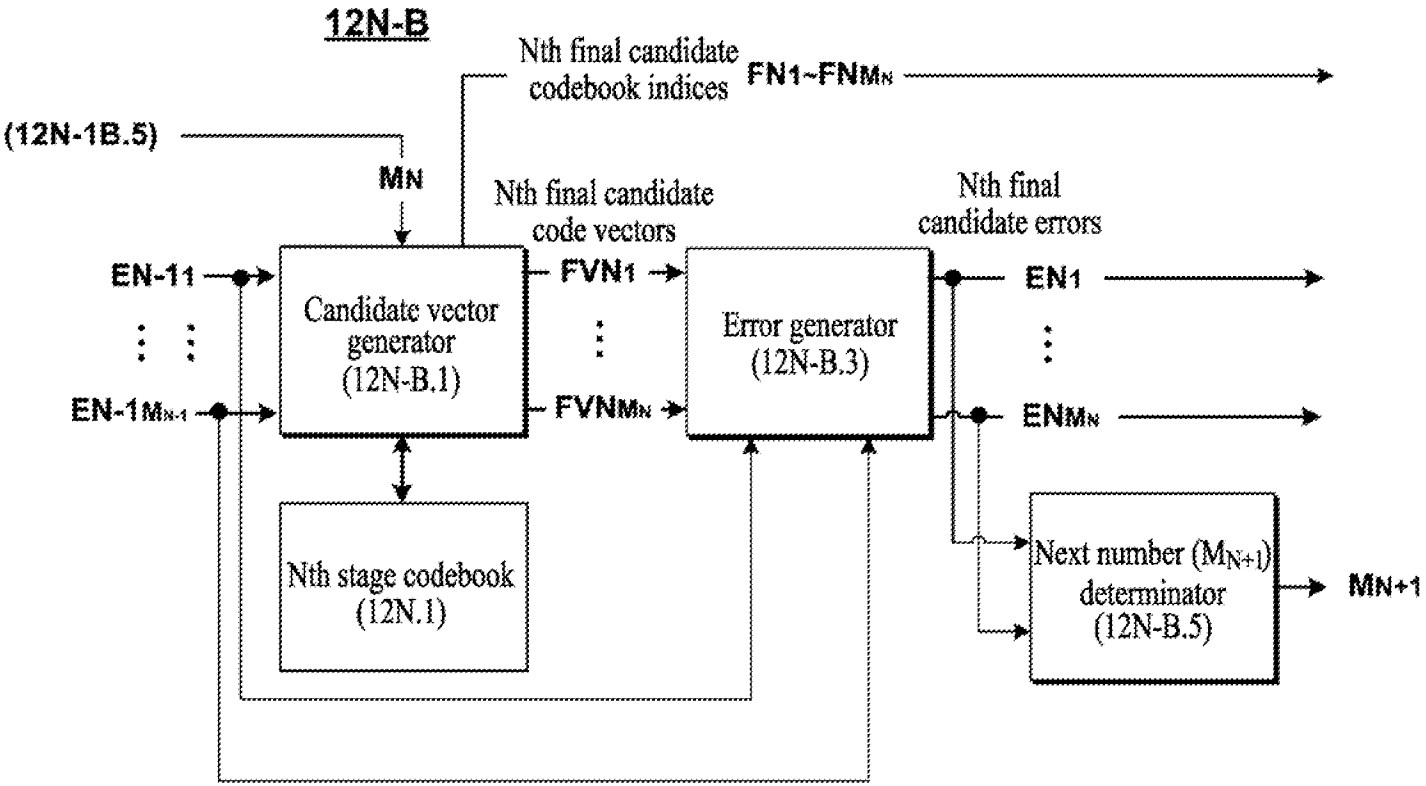
FIG. 6 illustrates a configuration of a second embodiment 12N-B of an Nth stage quantizer 12N of FIG. 1.

FIG. 5 illustrates a configuration of a second embodiment 121-B of the 1st stage quantizer 121 of FIG. 1 and FIG. 6 illustrates a configuration of a second embodiment 12N-B of the Nth stage quantizer 12N of FIG. 1.

As shown in FIG. 5, similar to the 1st stage quantizer 121-A according to the first embodiment, the 1st stage quantizer 121-B vector-quantizes the 1st target vector using the 1st stage codebook 121.1 to generate a temporarily determined number of 1st final candidate code vectors $FV1_1$ to $FV1_{Mpre}$ and corresponding 1st final candidate codebook indices $F1_1$ to $F1_{Mpre}$. In the 1st stage, the temporarily determined number $M_{pre}$ is the number of the 1st stage $M_1$ since, for the 1st stage, there is no number determined in the previous stage in the inter-stage scheme. The 1st stage codebook 121.1 may be equal to the 1st stage codebook 121.1 of FIG. 2 although the present invention is not limited thereto. The 1st final candidate codebook indices $F1_1$ to $F1_{Mpre}$ are provided to the index determinator 130 of FIG. 1.

The error generator 121-B.3 calculates errors between 1st final candidate code vectors $FV1_1$ to $FV1_{Mpre}$ and the 1st target vector to generate 1st final candidate errors $E1_1$ to $E1_{Mpre}$. Here, the errors may be calculated according to the above Expression 3. The 1st final candidate errors $E1_1$ to $E1_{Mpre}$ are provided as target vectors (2nd target vectors) of the next stage to the 2nd quantizer 12N (N=2).

The next number determinator 121-B.5 determines the number of candidate vectors (the 2nd number $M_2$) of the next stage based on the 1st final candidate errors $E1_1$ to $E1_{Mpre}$. A detailed description of the method of determining the next number is omitted herein since it is similar to the method of determining the current number by the current number determinator 121-A.5 of the intra-stage scheme (the first embodiment) described above. The number (i.e., the next number $M_2$) of the next stage described as described above is provided to the 2nd stage quantizer 12N-B (N=2).

Referring to FIG. 6, the Nth stage quantizer 12N-B includes a candidate vector generator 12N-B.1 and may further include an error generator 12N-B.3, a next number determinator 12N-B.5, and an Nth stage codebook 12N.1. When the Nth stage is the last stage, the Nth stage quantizer 12N-B does not include the error generator 12N-B.3 and the next number determinator 12N-B.5.

The candidate vector generator 12N-B.1 receives, as Nth target vectors, the N−1th final candidate errors $EN-1_1$ to $E-1_{MN-1}$ which are error signals of the N−1th stage. The candidate vector generator 12N-B.1 also receives the next number $M_N$ of the N−1th stage (i.e., the Nth number $M_N$). The candidate vector generator 12N-B.1 also vector-quantizes the target vectors using the Nth stage codebook 12N.1 to generate Nth final candidate code vectors $FVN_1$ to $FVN_{MN}$ corresponding to the Nth number $M_N$ and Nth final candidate codebook indices $FN_1$ to $FN_{MN}$ corresponding to the Nth final candidate code vectors $FVN_1$ to $FVN_{MN}$.

While the candidate vector generator of the 1st stage generates the same number of candidate vectors as the temporarily determined number $M_{pre}$ since there is no previous stage, the Nth stage candidate vector generator may finally generate the same number of candidate vectors as the next number of the N−1th stage (i.e., the Nth number $M_N$) since there is the previous stage (i.e., the N−1th stage).

Unlike the candidate vector generator 12N-A.1 of the intra-stage scheme (the first embodiment), which generates temporary candidate vectors since a final number of candidate code vectors has not been determined, the candidate vector generator of the inter-stage scheme (the second embodiment) generates final candidate code vectors since the number of candidate vectors of the current stage have been determined and received from the previous stage.

The procedure for generating the same number of Nth final candidate code vectors $FVN_1$ to $FVN_{MN}$ as the Nth number $M_N$ may be performed by generating the same number of temporary candidate code vectors as a predetermined number (for example, a temporary candidate code vectors for each target vector where a is a natural number) and selecting a final number $M_N$ of candidate code vectors from the temporary candidate code vectors based on the temporary candidate errors and pruning the remaining candidate code vectors as described above with reference to FIG. 4.

The Nth final candidate codebook indices $FN_1$ to $FN_{MN}$ generated in this manner are provided to the index determinator 130 of FIG. 1 and the Nth final candidate code vectors $FVN_1$ to $FVN_{MN}$ are provided to the error generator 12N-B.3.

Since the error generator 12N-B.3 and the next number determinator 12N-B.5 are not present when the Nth stage is the last stage as described above, the following description is applied only when the N+1 stage is present.

The error generator 12N-B.3 calculates errors between the Nth final candidate code vectors $FVN_1$ to $FVN_{mN}$ and target vectors $EN-1_1$ to $E-1_{MN-1}$ corresponding respectively to the code vectors to generate Nth final candidate errors $EN_1$ to $EN_{MN}$. The Nth final candidate errors $EN_1$ to $EN_{MN}$ are provided to the N+1th stage quantizer when the N+1th stage is present.

The next number determinator 12N-B.5 generates the number $M_{N+1}$ of candidate vectors of the next stage (i.e., the N+1th stage) and provides the same to the N+1th stage quantizer.

The audio signal processing method and apparatus according to the embodiment of the present invention may adaptively change the number of candidate code vectors (or candidate codebook indices) of each stage according to a current target signal error or a previous target signal error when performing multi-stage vector quantization.

An audio signal processing apparatus and method according to another embodiment are described below with reference to FIGS. 7 to 13.

Figure 7:
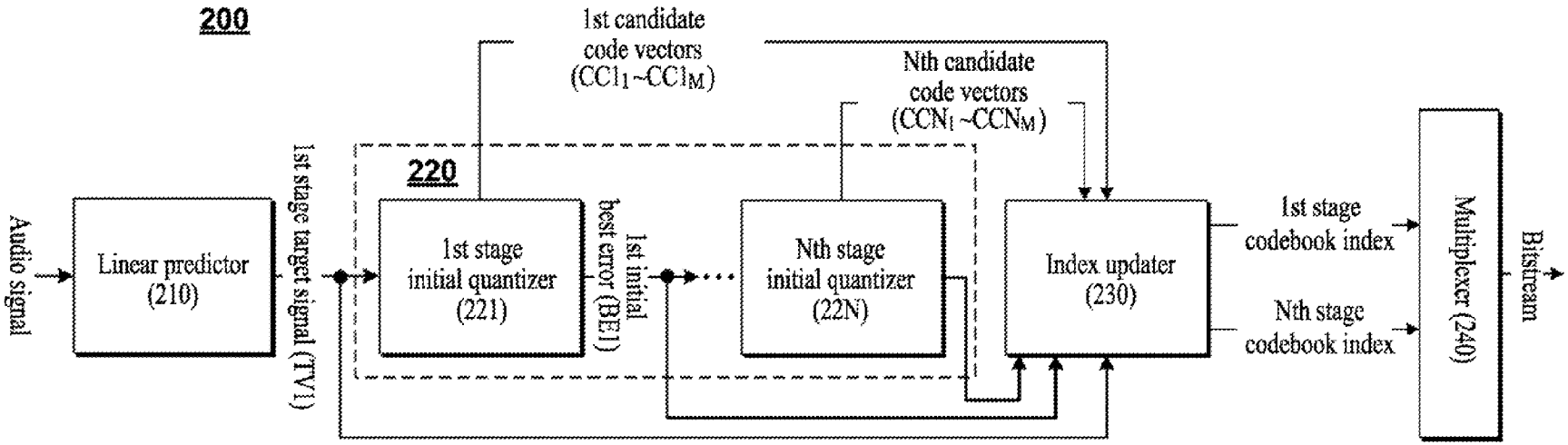
FIG. 7 illustrates a configuration of an encoder in an audio signal processing apparatus according to another embodiment of the present invention.

FIG. 7 illustrates a configuration of an encoder in an audio signal processing apparatus according to another embodiment of the present invention. As shown in FIG. 7, an encoder 200 includes initial quantizers 220 and an index updater 230 and may further include a linear predictor 210 and a multiplexer 240.

A description of the linear predictor 210 is omitted herein since the linear predictor 210 performs the same function as the linear predictor 110 of the encoder 100. The linear predictor 210 generates a target signal TV1 of a 1st stage using linear predictive conversion coefficient and provides the target signal TV1 to the multi-stage initial quantizers 220.

The initial quantizers 220 perform multi-stage quantization on the target vector received from the linear predictor 210 to generate 1st to Nth candidate code vectors $CC1_1$-$CC1_M$ to $CCN_1$-$CCN_M$ and provide the generated 1st to Nth candidate code vectors to the index updater 230. The initial quantizers 220 include 1st to Nth initial quantizers 221 to 22N. Operations of the 1st to Nth initial quantizers 221 to 22N are described below with reference to FIG. 8.

Figure 8:
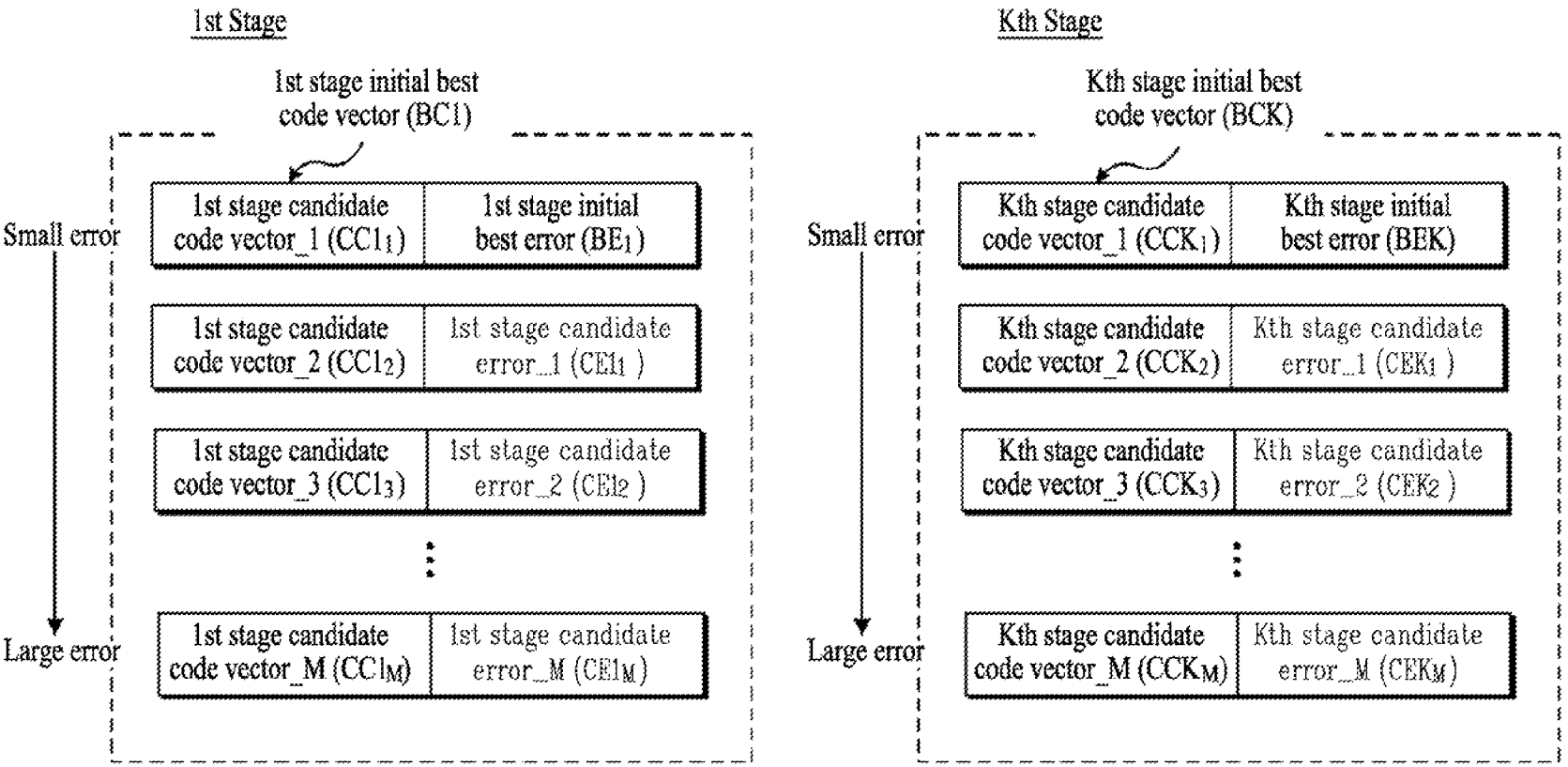
FIG. 8 illustrates exemplary output data of the initial quantizers 221 to 22N.

FIG. 8 illustrates exemplary output data of the initial quantizers 221 to 22N. In FIG. 8, the output data of the 1st stage initial quantizer 221 is shown at the left side and the output data of the Kth stage initial quantizer 22K is shown at the right side.

The 1st stage initial quantizer 221 vector-quantizes a target signal (or target vector) using a 1st stage codebook (not shown) to generate 1st stage candidate code vectors (1st candidate code vectors) $CC1_1$ to $CC1_M$. Here, the 1st stage codebook (not shown) may be the same as the 1st stage codebook 121.1 of FIG. 2 although the present invention is not limited thereto.

The number (M) of 1st candidate code vectors may be one of 1) a fixed value for all stages, 2) a preset value for each stage, and 3) an adaptively varying value. When the number (M) of 1st candidate code vectors is an adaptively varying value, the 1st stage initial quantizer 221 may be configured as shown in FIG. 2 (according to the intra-stage scheme) or as shown in FIG. 5 (according to the inter-stage scheme). That is, the 1st final candidate code vectors $FV_1$ to $FV1_{M1}$ of FIG. 2 or FIG. 5 correspond to the 1st candidate code vectors $CC1_1$ to $CC1_M$ of FIG. 8.

Candidate errors which are errors between the 1st candidate code vectors $CC1_1$ to $CC1_M$ and the target vector are calculated and the candidate code vectors are arranged in ascending order based on the errors. Then, a code vector having the smallest error among the arranged code vectors is referred to as a 1st stage (1st) initial best code vector BC1 and an error corresponding to the code vector is referred to as a 1st stage (1st) initial best error BE1. The 1st candidate code vectors $CC1_1$ to $CC1_M$ are provided to the index updater 230 of FIG. 7 and the 1st initial best error BE1 is provided as a target signal (or target vector) of the 2nd stage initial quantizer 22N (N=2).

That is, while a plurality of candidate code vectors is provided to the index updater 230, an error corresponding to a code vector whose error is the smallest among the plurality of candidate code vectors is provided as a target signal to the next stage. Although this target signal may be the best in the current stage, the target signal may not be the best when all stages are combined and therefore the index updater 230 performs a compensation process for the target signal at a later time.

Referring back to FIG. 7, similar to the 1st stage initial quantizer 221, the Nth stage initial quantizer 22N vector-quantizes the N−1th target signal using the Nth stage codebook to generate Nth candidate code vectors $CCN_1$ to $CCN_M$ and a code vector having the smallest error among the Nth candidate code vectors $CCN_1$ to $CCN_M$ is referred to as an Nth initial best code vector BCN. The Nth candidate code vectors $CCN_1$ to $CCN_M$ are provided to the index updater 230. In the same manner as described above, when the number of Nth candidate code vectors is an adaptively varying value, the Nth stage initial quantizer 22N may be constructed of the components as shown in FIG. 3 or FIG. 6.

The 1st candidate code vectors $CC1_1$ to $CC1_M$ including the 1st initial best code vector $CC1_1$ (=BC1) are provided to the index updater 230 and the 1st initial best error BE1 is provided to the index updater 230 and the initial quantizer 22N (N=2) of the next stage. The Nth candidate code vectors $CCN_1$ to $CCN_M$ including the Nth initial best code vector $CCN_1$ (=BCN) are also provided to the index updater 230 and the Nth initial best error BEN is provided to the index updater 230 when the Nth stage is the last stage.

The index updater 230 receives the 1st to Nth initial best code vectors $CCN_1$-$CC1_M$ to $CCN_1$ (=BCN) and determines whether or not to perform index update for a specific Kth stage. Then, the index updater 230 generates 1st to Nth final codebook indices and provides the same to the multiplexer 240. A detailed configuration of the index updater 230 is shown in FIGS. 9 and 10.

The multiplexer 240 generates at least one bitstream including the 1st to Nth final codebook indices generated by the index updater 230 and provides the bitstream to the decoder.

Detailed operations of an embodiment of the index updater 230 are described below with reference to FIGS. 9 and 10. FIG. 9 illustrates a detailed configuration of an embodiment of the index updater 230 of FIG. 7 and FIG. 10 illustrates a detailed configuration of an embodiment of the Kth stage updater 23K of FIG. 9.

Figure 9:
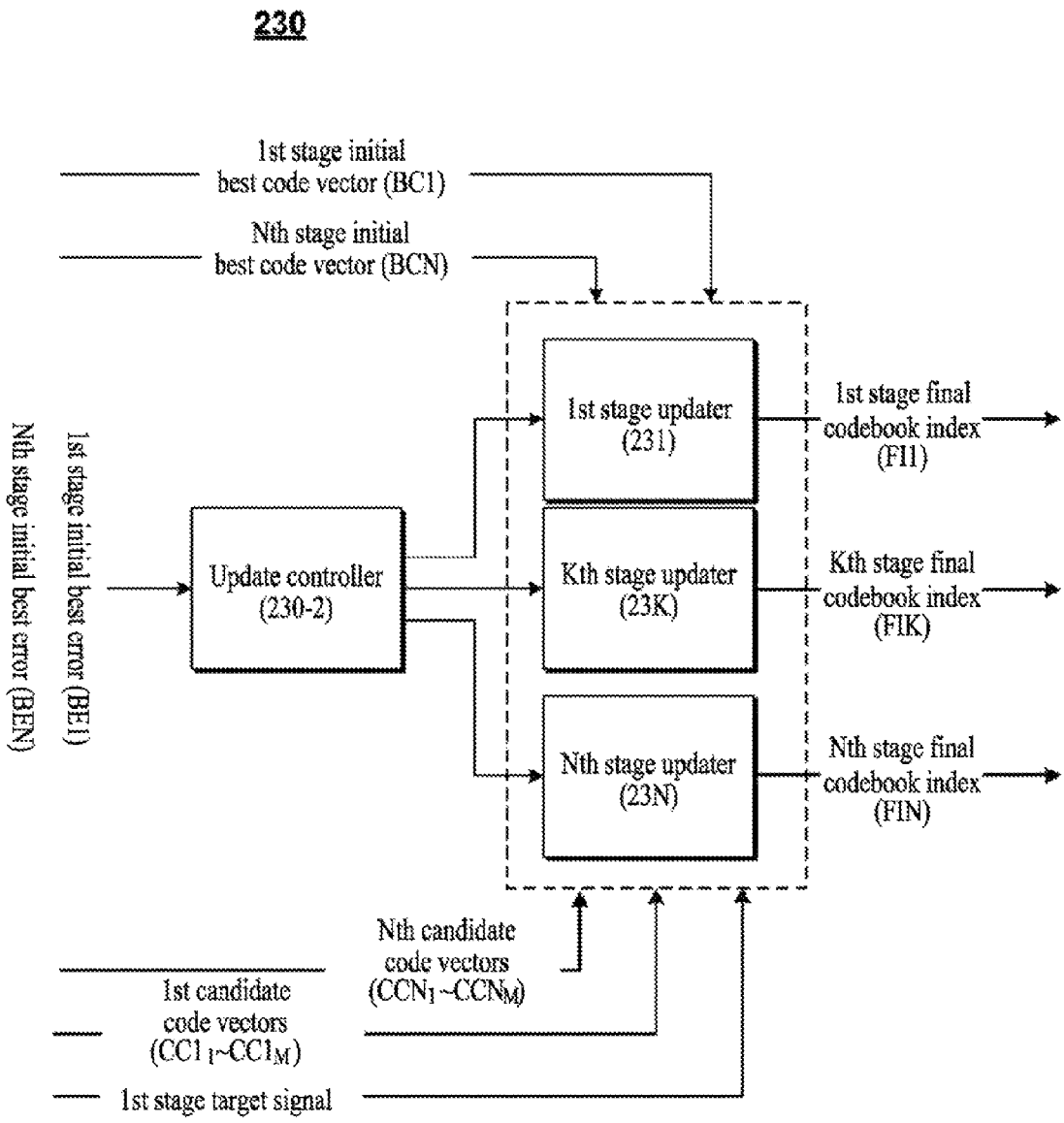
FIG. 9 illustrates a detailed configuration of an embodiment of the index updater 230 of FIG. 7.
Figure 10:
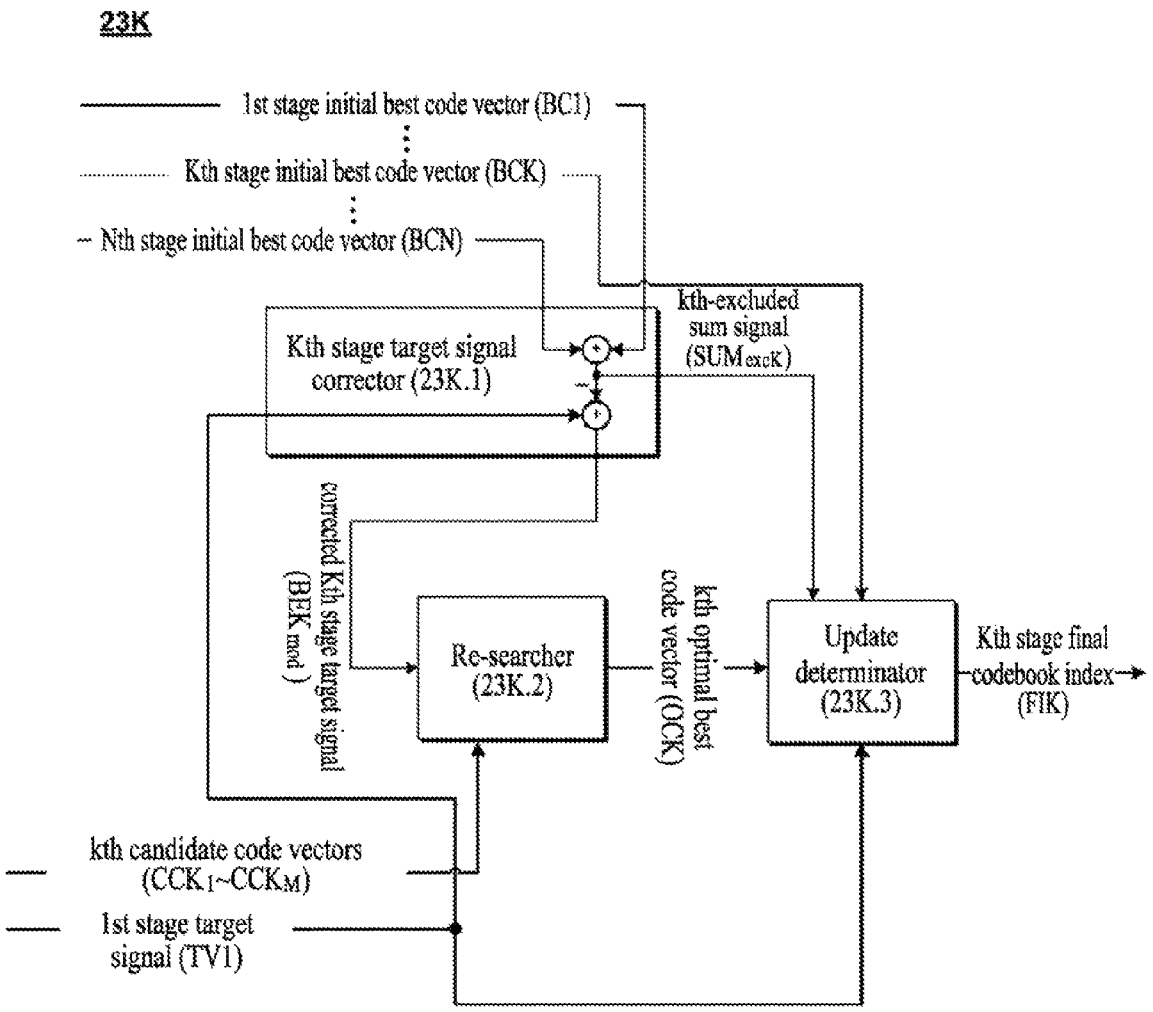
FIG. 10 illustrates a detailed configuration of an embodiment of the Kth stage updater 23K of FIG. 9.

As shown in FIG. 9, the index updater 230 includes an update controller 230-2 and also includes at least one of 1st to Kth stage updaters 231 to 23K and K+1th to Nth stage updaters 23K+1 to 23N.

The update controller 230-2 determines a stage in which index replacement (or update) is to be performed from among all stages (Kth stage, K=1, . . . , N) based on 1st to Nth initial best errors BE1 to BEN. Here, the update controller 230-2 first determines a stage having greatest error as the stage in which index update is to be performed. The update controller 230-2 activates the 1st stage updater 231 upon determining that index update is to be performed in the 1st stage and activates the Nth stage updater 23N upon determining that index update is to be performed in the Nth stage. An example in which the update controller 230-2 activates the 1st stage updater 23K upon determining that index update is to be performed in the Kth stage (K=1, . . . , N) will be described late with reference to FIG. 10.

After the update controller 230-2 replaces (or updates) indices for the stage (for example, the Kth stage) having the greatest error as described above, the update controller 230-2 may chose whether or not to replace indices for a stage (for example, K+ath stage (a: integer)) having the second greatest error. When a Kth initial best code vector has been replaced or updated with a Kth optimal best code vector, the update controller 230-2 may perform index update for stages after the K+ath stage. On the other hand, when the Kth initial best code vector has not been replaced with the Kth optimal best code vector and has been determined to be the Kth final code vector FCH, the update controller 230-2 may not perform index update for stages after the K+ath stage or may perform index update only for the K+ath stage.

The Kth stage updater 23K (K=1, . . . , N) is described below with reference to FIG. 10. As shown in FIG. 10, the Kth stage updater 23K includes a Kth stage target signal corrector 23K.1, a re-searcher 23K.2, and an update determinator 23K.3.

The Kth stage target signal corrector 23K.1 receives initial best code vectors BC1 to BCN (excluding BCK) for stages other than the Kth stage and the 1st stage target signal and corrects the target signal of the Kth stage based on the received initial best code vectors and the 1st stage target signal to generate a corrected kth target signal.

Specifically, first, the Kth stage target signal corrector 23K.1 sums initial best code vectors of all stages excluding the Kth stage to generate a Kth-excluded sum signal $SUM_{expK}$ as follows.

$$SUM_{expK}=BC1+\ldots+BCK-1+BCK+1+\ldots+BCN \qquad \text{Expression 4}$$

Here, BC1 is a 1st (1st stage) initial best code vector,

BCK−1 is a K−1th (K−1th stage) initial best code vector,

BCK+1 is a K+1th (K+lth stage) initial best code vector, and

BCK is a Kth (Kth stage) initial best code vector.

The initial best code vector of each stage corresponds to a code vector having the smallest error in the stage when the initial quantizer of each stage of FIG. 7 has set one candidate code vector.

In this manner, the Kth stage target signal corrector 23K.1 generates a Kth-excluded sum signal $SUM_{expK}$ excluding only the Kth initial best code vector and subtracts the Kth-excluded sum signal $SUM_{expK}$ from the 1st target vector TV1 to generate a corrected Kth target signal $TVK_{mod}$.

$$TVK_{mod}=TV1-SUM_{expK} \qquad \text{Expression 5}$$

Here, $TVK_{mod}$ is the corrected Kth target signal, $SUM_{expK}$ is the Kth-excluded sum signal ($SUM_{expK}$=BC1+ . . . +BCK−1+BCK+1+ . . . +BCN), and TV1 is the 1st target signal (or 1st target vector).

The re-searcher 23K.2 recalculates errors of the Kth candidate code vectors $CCK_1$ to $CCK_M$, which have been searched for (or found) by the Kth initial quantizer 22K, based on the corrected Kth target signal $TVK_{mod}$ and determines that a code vector having the smallest error among the Kth candidate code vectors $CCK_1$ to $CCK_M$ is a Kth optimal best code vector OCK. That is, unlike the Kth target signal TVK which has been the best candidate error BEK-1 in the K-1th stage, the corrected Kth target signal $TVK_{mod}$ up to the initial best code vectors after the K+1th stage such that errors of the errors of the stages after the K+1th stage are reflected in the signal. Accordingly, when the errors of the Kth candidate code vectors $CCK_1$ to $CCK_M$ are recalculated based on the corrected Kth target signal $TVK_{mod}$ rather than the Kth target signal $TV_K$, the errors of the Kth candidate code vectors $CCK_1$ to $CCK_M$ are always changed. Accordingly, the errors of the Kth candidate code vectors $CCK_1$ to $CCK_M$ are recalculated based on the corrected Kth target signal $TVK_{mod}$ and a Kth optimal best code vector OCK having the smallest recalculated error is selected.

The update determinator 23K.3 receives the Kth initial best code vector BCK from the Kth initial quantizer 22K and the Kth optimal best code vector OCK from the re-searcher 23K.2. The update determinator 23K.3 determines that a code vector having the smaller total error among the Kth initial best code vector BCK and the Kth optimal best code vector OCK is the Kth stage final code vector FCK. Here, the update determinator 23K.3 uses the 1st target signal TV1 from the linear predictor 210 and the Kth-excluded sum signal $SUM_{excK}$ from the Kth stage target signal corrector 23K.1 in order to calculate the total error.

$$E_{BCK}=TV1-(BCK+SUM_{excK})$$

$$E_{OCK}=TV1-(OCK+SUM_{excK})$$

Here, $E_{BCK}$ is the total error for the Kth initial best code vector (hereinafter referred to as a 1st total error), $E_{OCK}$ is the total error for the Kth initial best code vector (hereinafter referred to as a 2nd total error), BCK is the Kth initial best code vector, OCK is the Kth optimal best code vector, and $SUM_{excK}$ is the Kth-excluded sum signal.

That is, if the 1st total error is the smaller, the update determinator 23K.3 does not replace the Kth initial best code vector BCK with the Kth optimal best code vector OCK since the Kth initial best code vector BCK is better and determines that the Kth initial best code vector BCK is the Kth final code vector FCK. On the other hand, if the 2nd total error is the smaller, the update determinator 23K.3 replaces the Kth optimal best code vector OCK with the Kth optimal best code vector OCK generated based on the corrected Kth stage target signal $BEK_{mod}$ and determines the same to be the Kth final code vector FCK.

The update determinator 23K.3 then provides a codebook index FIK corresponding to the Kth final code vector FCK as a Kth final code vector index to the multiplexer 240 of FIG. 7.

Referring back to FIG. 9, in the case in which index update has been performed for the K+ath stage after the Kth final code vector FCK is determined to be one of the Kth initial best code vector BCK and the Kth optimal best code vector OCK by performing index update in the Kth stage, the Kth final code vector FCK rather than the Kth initial best code vector BCK is input to the K+ath stage updater 23K+a.

As described above, according to the audio signal processing method and apparatus according to another embodiment shown in FIGS. 7 to 13, first, the number of candidates is set to a small number (for example, 1) and multi-stage quantization is performed primarily based on the set small number and therefore it is possible to greatly reduce complexity due to multi-stage quantization. In addition, the initial best code vector is replaced with the optimal best code vector for a stage having a high error (for example, the Kth stage such as the K+ath stage) provided that replacement reduces the error and therefore it is possible to greatly reduce vector quantization errors.

The audio signal processing apparatus according to the present invention may be included and used in various products. Such products may be largely divided into a standalone group and a portable group and the standalone group may include a TV, a monitor, and a set-top box and the portable group may include a PMP, a mobile phone, and a navigation device.

Figure 11:
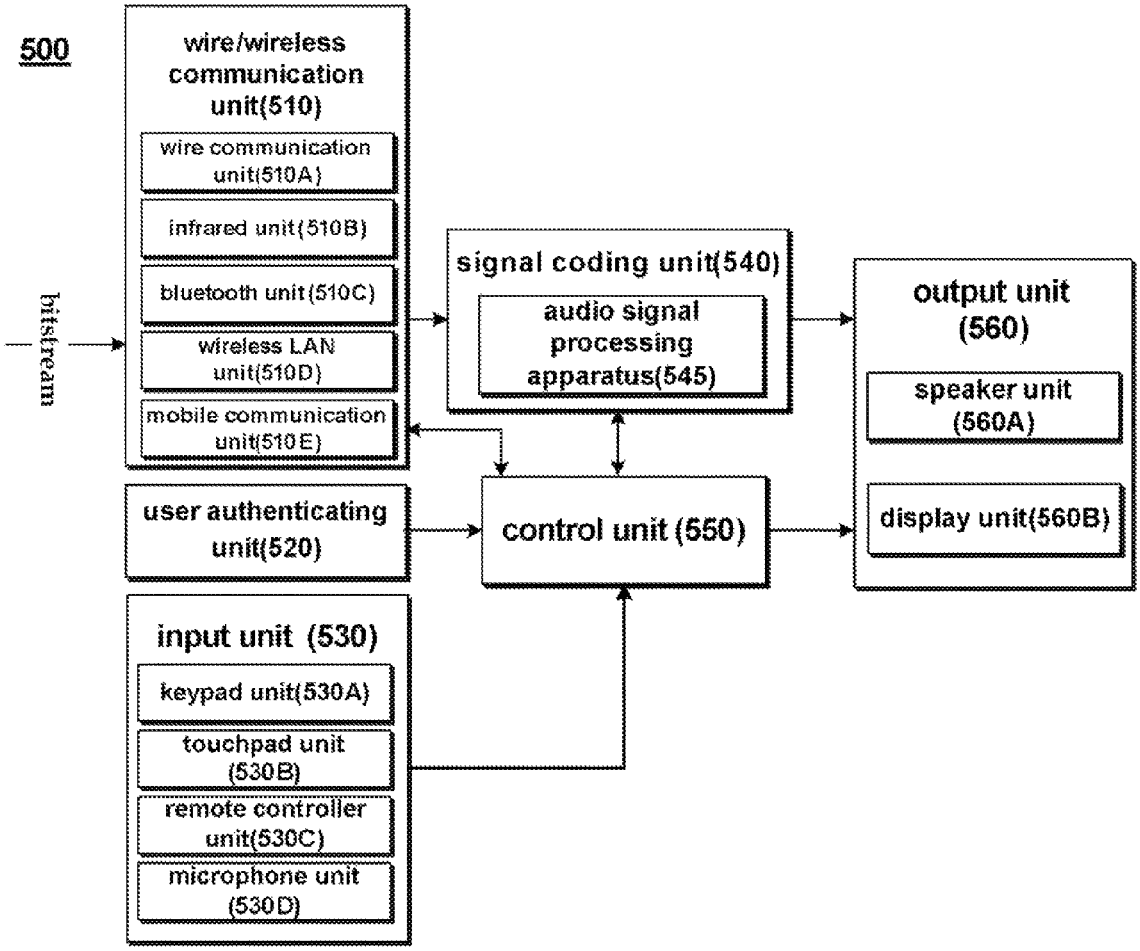
FIG. 11 illustrates products in which an audio signal processing apparatus according to an embodiment of the present invention is implemented.

FIG. 11 illustrates products in which an audio signal processing apparatus according to an embodiment of the present invention is implemented. As shown in FIG. 11, a wired/wireless communication unit receives a bitstream through a wired/wireless communication scheme. Specifically, the wired/wireless communication unit 510 may include at least one of a wired communication unit 510A, an infrared communication unit (or infrared unit) 510B, a Bluetooth unit 510C, a wireless LAN communication unit 510D, a mobile communication unit 510E.

A user authenticating unit 520 receives user information and performs user authentication and may include at least one of a fingerprint recognition unit, an iris recognition unit, a face recognition unit, and a voice recognition unit. The fingerprint recognition unit, the iris recognition unit, the face recognition unit, and a voice recognition unit may receive fingerprint information, iris information, face profile information, and voice (or speech) information and convert the same into user information and may then determines whether or not the user information is identical to registered user data to perform user authentication.

An input unit 530 is an input device for allowing a user to input various types of commands. The input unit 530 may include at least one of a keypad unit 530A, a touchpad unit 530B, a remote controller unit 530B, and a microphone unit 530D although the present invention is not limited thereto. Here, the microphone unit 530D is an input device for receiving a speech or audio signal. The keypad unit 530A, the touchpad unit 530B, and the remote controller unit 530B may receive a command to make a call or a command to activate the microphone unit 530D. When a controller 550 receives a command to make a call through the keypad unit 530B or the like, the controller 550 may allows the mobile communication unit 510E to send a call request to a mobile communication network.

A signal coding unit 540 encodes or decodes an audio signal and/or a video signal received through the microphone unit 530D or the wired/wireless communication unit 510 and outputs an audio signal of the time domain. The signal coding unit 540 includes an audio signal processing device 545 that corresponds to an embodiment of the present invention (i.e., the encoder 100 or 200 according to the embodiments) described above. The audio signal processing device 545 and a signal coding unit including the audio signal processing device 545 may be implemented using one or more processors.

The controller 550 receives an input signal from input devices and controls all operations of the signal decoding unit 540 and the output unit 560. The output unit 560 is a component through which an output signal generated by the signal decoding unit 540 or the like is output and may include a speaker unit 560A and a display unit 560B. When the output signal is an audio signal, the output signal is output through the speaker and, when the output signal is a video signal, the video signal is output through the display.

Figure 12:
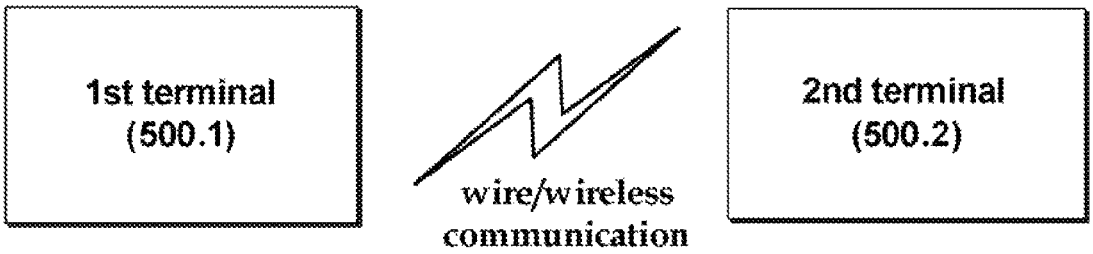
FIG. 12 illustrates products in which an audio signal processing apparatus according to an embodiment of the present invention is implemented.
Figure 12:
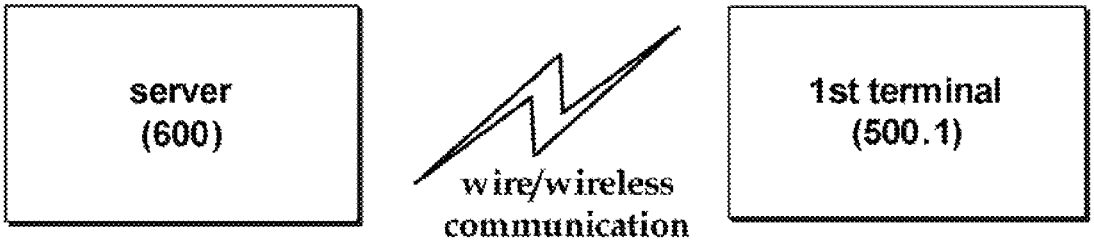

FIG. 12 illustrates products in which an audio signal processing apparatus according to an embodiment of the present invention is implemented. Specifically, FIG. 12 illustrates a relationship between a server and a terminal corresponding to the product shown in FIG. 11. From FIG. 12(A), it can be seen that each of a first terminal 500.1 and a second terminal 500.2 can communicate data or bitstreams in both ways through a wired/wireless communication unit. From FIG. 12(B), a server 600 and the first terminal 500.1 can also perform wired/wireless communication with each other.

Figure 13:
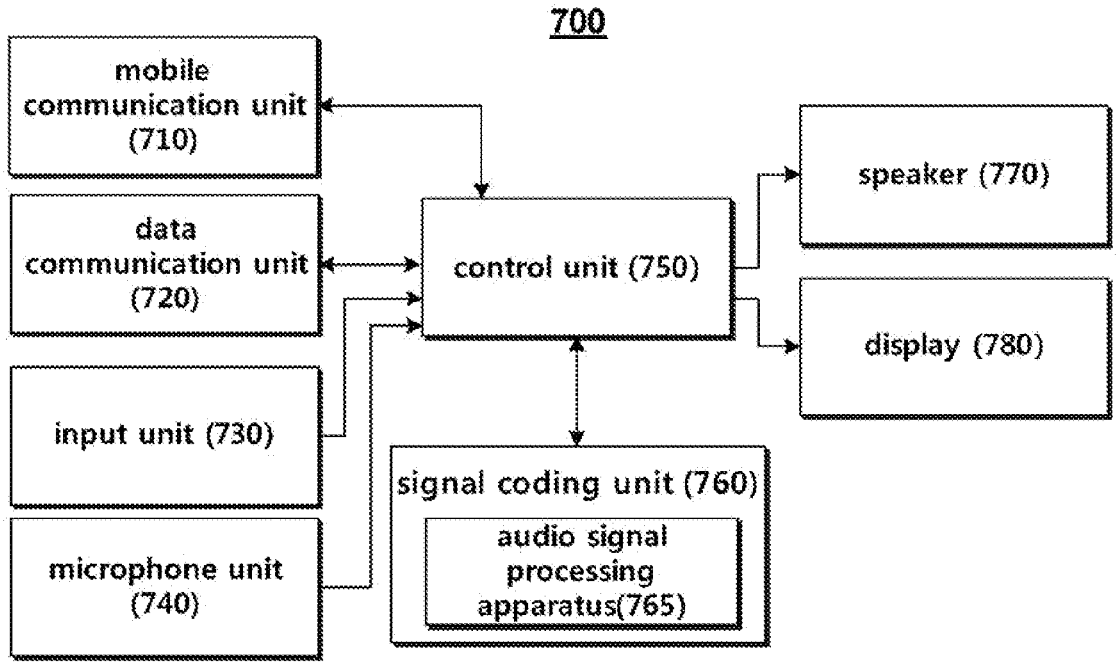
FIG. 13 illustrates a schematic configuration of a mobile terminal in which an audio signal processing apparatus according to an embodiment of the present invention is implemented.

FIG. 13 illustrates a schematic configuration of a mobile terminal in which an audio signal processing apparatus according to an embodiment of the present invention is implemented. A mobile terminal 700 may include a mobile communication unit 710 for sending and receiving calls, a data communication unit 720 for data communication, an input unit 730 for receiving a command to make a call or a command associated with audio input, a microphone unit 740 for receiving a speech or audio signal, a controller 750 for controlling each component, a signal coding unit 760, a speaker 770 for outputting a speech or audio signal, and a display 780 for outputting a screen.

The signal coding unit 760 encodes or decodes an audio signal and/or a video signal received through the data communication unit 720 or the microphone unit 530D and outputs an audio signal of the time domain through the mobile communication unit 710, the data communication unit 720, or the speaker 770. The signal coding unit 760 includes an audio signal processing device 765 that corresponds to an embodiment of the present invention (i.e., the encoder 100 and/or the decoder 200 according to the embodiments) described above. The audio signal processing device 765 and a signal coding unit including the audio signal processing device 765 may be implemented using one or more processors.

The audio signal processing method according to the present invention may be embodied as a program that is to be executed by a computer and may then be stored in a computer readable recording medium. Multimedia data having a data structure according to the present invention may also be stored in a computer readable recording medium. The computer readable recording medium includes any type of storage device that stores data which can be read by a computer system. Examples of the computer readable recording medium include ROM, RAM, CD-ROMs, magnetic tapes, floppy disks, optical data storage devices, and so on. The computer readable recording medium may also be embodied in the form of carrier waves (for example, signals transmitted over the Internet). A bitstream generated according to the encoding method described above may be stored in a computer readable recording medium or may be transmitted using a wired/wireless communication network.

Although the present invention has been described with reference to the specific embodiments and the drawings, the present invention is not limited to the embodiments and those skilled in the art will be able to make various modifications, additions, and substitutions from the description, without departing from the scope and spirit of the invention as disclosed in the accompanying claims.

[Industrial Applicability]

The present invention is applicable to audio signal encoding and decoding.

The invention claimed is:

1. An audio signal processing method comprising:

generating a first target signal based on a plurality of linear predictive conversion coefficients by performing linear predictive analysis on a current frame of an audio signal;

performing vector quantization on a first stage based on the first target signal, the vector quantization including generating first candidate code vectors including a first initial best code vector having a smallest error based on the first target signal and outputting a first initial best error corresponding to the first initial best code vector as a second target signal which is a target signal of a second stage;

repeatedly performing the vector quantization from the second stage to an Nth stage;

determining a Kth stage (K=1, . . . , N) in which index update is to be performed among the first to Nth stages;

correcting the Kth target signal using the first target signal and an Kth-excluded sum signal;

determining a Kth optimal best code vector among Kth candidate code vectors based on the corrected Kth target signal; and selecting one of a Kth initial best code vector and the Kth optimal best code vector as a Kth final best code vector, wherein the Kth-excluded sum signal is a sum of first to Nth initial best code vectors excluding the Kth initial best code vector.

2. The audio signal processing method according to claim 1, wherein the selection is performed based on a total error of the Kth initial best code vector and a total error of the Kth optimal best code vector, the total error of the Kth initial best code vector is a difference between a vector obtained by summing the Kth-excluded sum signal and the Kth initial best code vector and the first target signal, and the total error of the Kth initial best code vector is a difference between a vector obtained by summing the Kth-excluded sum signal and the Kth initial best code vector and the first target signal.

3. The audio signal processing method according to claim 1, further comprising:

determining a K+ath stage (a: integer) in which index update is to be performed among the first to Nth stages; and repeating the update, the determination, and the selection for the K+ath stage.

4. The audio signal processing method according to claim 3, wherein the determination of the K+ath stage and the repetition are performed when the Kth optimal best code vector is determined to be the Kth final best code vector.

5. An audio signal processing apparatus comprising:

a linear predictor for performing linear predictive analysis on a current frame of an audio signal and generating a first target signal based on a plurality of linear predictive conversion coefficients;

initial quantizers for performing vector quantization on a total of N stages based on the first target signal, the initial quantizers including a first initial quantizer that performs vector quantization on the first stage by generating first candidate code vectors including a first initial best code vector having a smallest error based on the first target signal and outputting a first initial best error corresponding to the first initial best code vector as a second target signal which is a target signal of a second stage and ith initial quantizer for performing the vector quantization based on ith target signal (i=2, . . . , N);

an update controller for determining a Kth stage (K=1, . . . , N) in which index update is to be performed from among the first to Nth stages;

a Kth stage target signal corrector for correcting the Kth target signal using the first target signal and an Kth-excluded sum signal;

a re-searcher for determining a Kth optimal best code vector from among Kth candidate code vectors based on the corrected Kth target signal; and an update determinator for selecting one of a Kth initial best code vector and the Kth optimal best code vector as a Kth final best code vector, wherein the Kth-excluded sum signal is a sum of first to Nth initial best code vectors excluding the Kth initial best code vector.

* * * * *